United States Patent [19]

Allen

[11] Patent Number: 4,742,992

[45] Date of Patent: May 10, 1988

[54] ROOFING MEMBRANE PULLER

[76] Inventor: Thomas H. Allen, 1365 Field Ct., Mount Horeb, Wis. 53572

[21] Appl. No.: 35,438

[22] Filed: Apr. 7, 1987

[51] Int. Cl.[4] ..... B25B 33/00

[52] U.S. Cl. ..... 254/199; 254/208; 254/212

[58] Field of Search ..... 254/208, 209, 212, 225, 254/226, 242, 243, 413, 415, 256, 261, 335, 199

[56] References Cited

U.S. PATENT DOCUMENTS

| | | | |
|---|---|---|---|
| 334,665 | 1/1886 | Jones | 254/208 |
| 395,445 | 1/1889 | Lamb | 254/208 X |
| 761,151 | 5/1904 | Cummings | 254/256 X |
| 932,382 | 8/1909 | Frank | 254/226 X |
| 2,284,532 | 5/1942 | Napier | 254/335 |
| 4,560,146 | 12/1985 | Thomas | 254/208 X |

*Primary Examiner*—Stuart S. Levy
*Assistant Examiner*—Katherine Matecki
*Attorney, Agent, or Firm*—Isaksen, Lathrop, Esch, Hart & Clark

[57] ABSTRACT

A roofing membrane puller for tautly pulling a waterproof membrane over a flat roof, even to the edges thereof, includes a frame, at least one anchor which maintains the frame in a selected position on the flat roof, a locking gripper having releasably lockable jaws for gripping the membrane, a leveraged hand drive which is mounted to the frame and includes a lever which is pivotally mounted to the frame and can be grasped by an operator's hand to move the lever and apply a force to the lever in driving direction, and a pulley-cable system for transmitting a pulling force from the leveraged hand drive to the locking gripper to pull the membrane. A cable extends from the leveraged hand drive through at least one pulley where the cable's direction can be changed so that the cable and locking gripper can pull the membrane in a direction which is generally perpendicular to the longitudinal axis of the puller frame. This exit pulley may be connected to the front end of the frame through an extender which projects the exit pulley in a forward direction from the front end of the frame so that the exit pulley can be projected near to the edge of the roof by placing the puller near the edge of the roof with its longitudinal axis at a slight angle thereto.

11 Claims, 3 Drawing Sheets

4
85
74
64
75
98
63
77
80
81
82
4
86
21
5
3
5
17a
87
33
96
17b
43
23
88
22
43
95
44
92
41
41
44
89
39
93
78
39
91
27
73
16
26
56
57
57
36
100
32
29
10
35
69
100
68
31
84
55
83
19
72
20
61
50
51
65
25
66
41
46
17c
3

96
78
33
21
23
17a
22
40
43
38
39
10
73
57
56
32
36
29
35
69
31
53
84
19
83
55
72
26
73
51
68
50
61
20
65
66
16
17c
100
25
41
43
46
44

ROOFING MEMBRANE PULLER

BACKGROUND OF THE INVENTION

1. Field of the Invention

The present invention relates to devices which are used for pulling large sheets of material, and more particularly to devices which are used for pulling water-proof membranes over flat roofs.

2. Description of the Prior Art

Buildings with flat tops often have roofs installed with a membrane-type material. This roofing material comes in sheets which are pulled across the flat top of the building. Since the roofing material is flexible and difficult to pull so that it is taut, the finished roof is normally quite wrinkled in appearance. While the wrinkling does not adversely affect the weatherability of the roof, it is considered aesthetically unacceptable by some customers.

One prior art roofing material puller was made for pulling this membrane-type roofing material. The device included a wooden base, a wooden lever pivotally attached to the base, and a cable fastened to the lever and extending through a grommet at the front end of the base, for guiding the cable. At the other end of the cable, the puller included a gripping member to grip the membrane. The roofing membrane was pulled by placing the front of the base facing the membrane, attaching the gripping member to the membrane, and then pulling the lever in a direction away from the membrane. The device could only be held in place by nailing to prevent the device from sliding forwardly on the roof when the membrane was being pulled. Since using this device required placing it with its front facing the membrane, the membrane could not be pulled all the way to the edge of the flat roof using this puller. The membrane could only be pulled up to the front of the base, where it was separated from the edge of the roof by a distance which was approximately equal to the length of the device's base.

Other devices have been developed for pulling sheet material such as carpets. For example, U.S. Pat. No. 1,971,218 to Hoobler discloses a carpet vice which includes gripping jaws connected to a tong-like apparatus. At the other end of the device are teeth which are intended to grip the floor as the carpet is pulled. An "L" shaped lever at its lower end engages slots in the device and is designed to be pulled toward the direction of the teeth, thereby pulling the carpet. Again, the lever action of this device is directed away from the carpet material which is being pulled, and requires that the front of the device face the carpet.

Other prior art pulling devices include those shown in U.S. Pat. Nos. 58,653 to Lindner, 498,977 to Harvey, and 2,665,884 to Martin.

SUMMARY OF THE INVENTION

The present invention is summarized in that a roofing membrane puller for tautly pulling a water-proof membrane over a flat roof includes a frame having a front end, a rear end, and two sides; at least one anchor which maintains the frame in a selected position on the flat roof; a locking gripper having releasably lockable jaws for gripping the membrane; a leveraged hand drive which is mounted to the frame and includes a lever which at a lower end thereof is pivotally mounted to the frame near one end of the frame and at another end of the lever is grasped by an operator's hand to move the lever and apply a force to the lever in a driving direction which is parallel to the longitudinal axis of the frame; and a pulley-cable system for transmitting a pulling force from the leveraged hand drive to the locking gripper to pull the membrane. The pulley-cable system includes an exit pulley which is in a connected relation to the frame near the front end thereof, the exit pulley having a groove therearound and at least one position in which a turning axis of the exit pulley is perpendicular to the roof, and a cable which includes a first end which is connected to the leveraged hand drive and a second end which is connected to the locking gripper. The cable extends from the leveraged hand drive in an initial direction which is generally opposite the driving direction of the lever to define an initial portion of the cable. The cable ultimately passes through the exit pulley groove to extend in a final direction to the locking gripper to define a final portion of the cable, the final direction being determined by selected relative positions of the exit pulley and the locking gripper. The roofing membrane puller may further include an extender through which the exit pulley is in a connected relation to the frame. At least a portion of the extender projects outwardly from the front end of the frame with the exit pulley being connected to an outward end of the extender. The extender can serve the purpose of projecting the pulley outwardly from the front end of the frame so that the roofing membrane puller can be placed near the edge of the roof with its front end directed obliquely toward the edge of the roof so that the extender projects the exit pulley outwardly toward the roof edge. Thus the roofing membrane can be drawn outwardly near the roof edge when the exit pulley is positioned so that its turning axis is perpendicular to the roof and the cable is extended from the exit pulley in a sideward direction.

A primary object of the invention is to provide a roofing membrane puller for tautly and efficiently pulling a water-proof membrane over a flat roof, thereby reducing wrinkling of the membrane.

A second object of the invention is to provide a roofing membrane puller which can be used to tautly pull the water-proof membrane nearly to the edges of a flat roof.

An additional object of the invention is to provide a roofing membrane puller which has anchors with serrated teeth which grip the flat roof and immobilize the puller frame.

A further object of the invention is to provide the roofing membrane puller in which at least one of the anchors is an outwardly extending leg having an upward surface on which a foot of the operator may be placed to hold the puller frame firmly in place on the roof.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
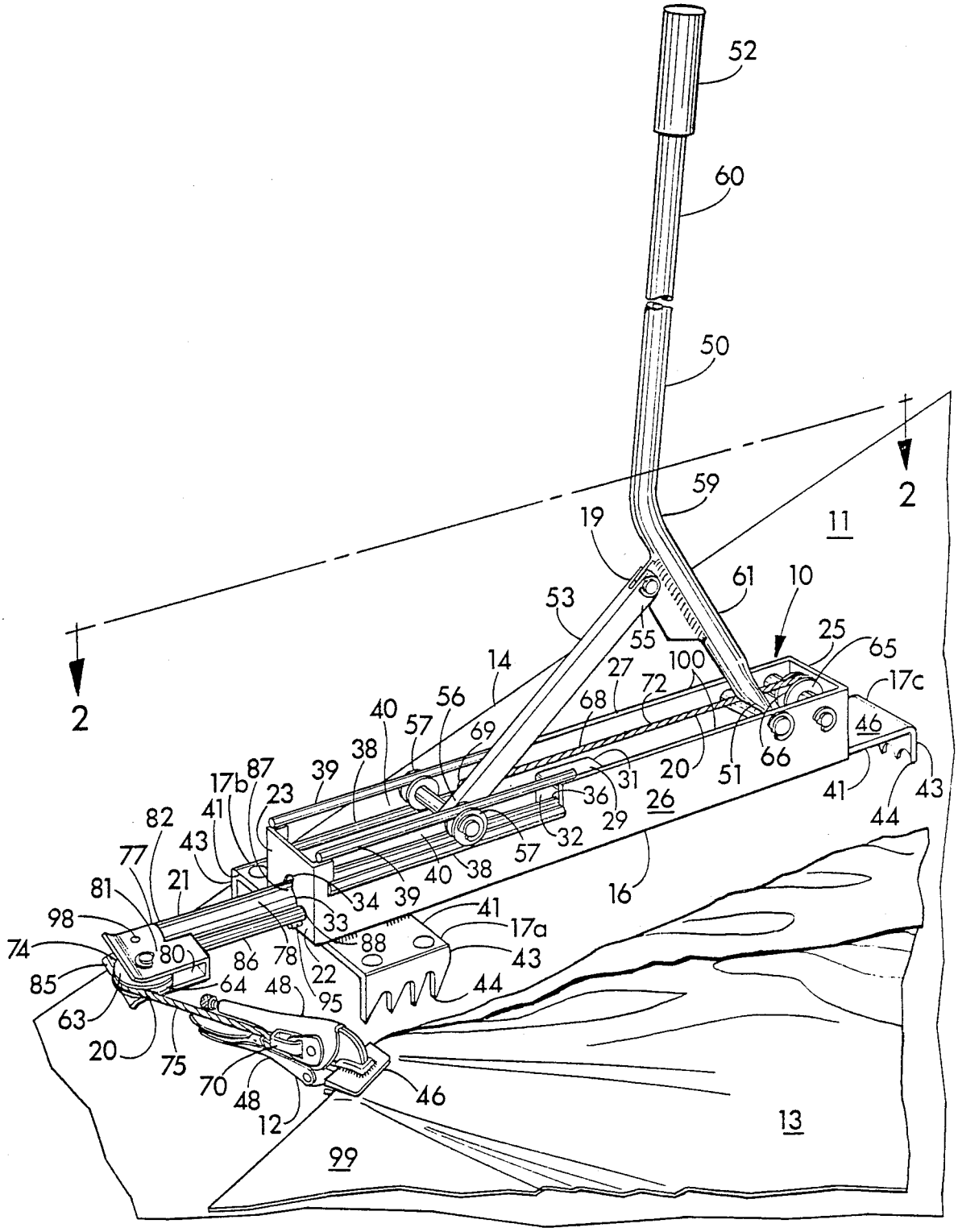
FIG. 1 is a perspective view of the roofing membrane puller of the present invention positioned near an edge of a roof with the exit pulley extending so the cable and locking gripper can pull the membrane almost to the roof's edge.
Figure 2:
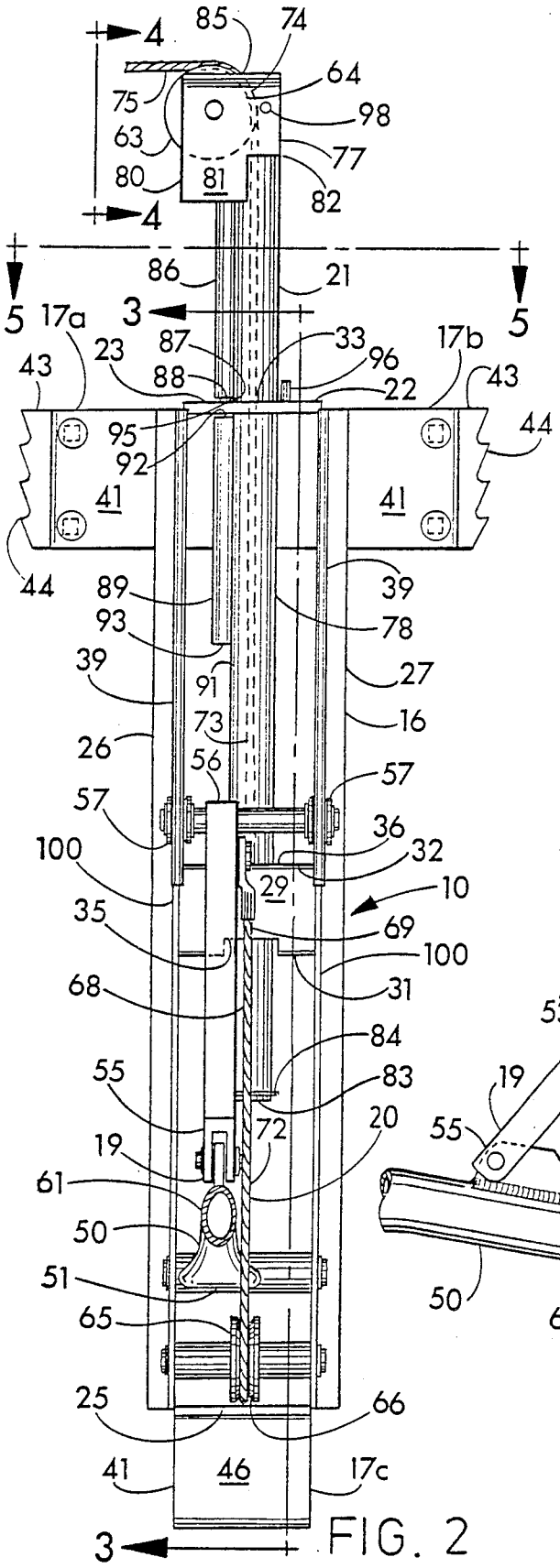
FIG. 2 is a top plan view of the roofing membrane puller, taken in accordance with section line 2—2 of FIG. 1.

Referring more particularly to the drawings, wherein like numbers refer to like parts, FIG. 1 shows a roofing membrane puller 10 constructed in accordance with the present invention shown in perspective view on a flat roof 11, with a locking gripper 12 gripping and pulling on a water-proof membrane 13 which is being pulled over the roof 11 nearly to the edges 14 thereof to seal the roof. FIG. 2 shows the roofing membrane puller top plan view in accordance with section line 2—2 of FIG. 1. As shown in FIGS. 1 and 2, the roofing membrane puller includes a frame 16, three anchors 17*a*, 17*b* and 17*c*, which maintain the frame 16 in a selected position on the flat roof 11, a locking gripper 12, a leveraged hand drive 19 which is mounted to the frame 16, and a pulley-cable system 20 for transmitting a pulling force from the leveraged hand drive 19 to the locking gripper 12 to pull the membrane 13. The roofing membrane puller 10 further includes an extender 21 which aids in pulling the membrane 13 close to the edge 14 of the flat roof 11.

Figure 3:
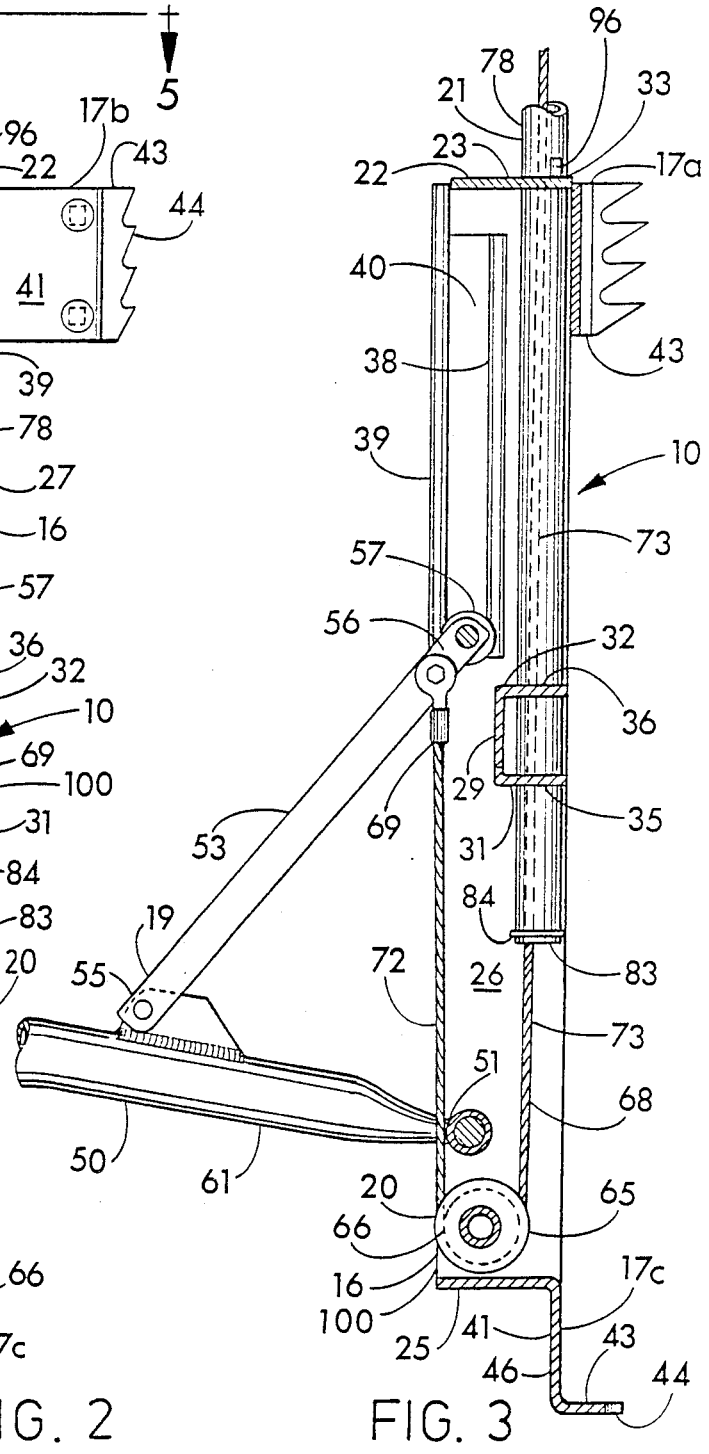
FIG. 3 is a section view taken along section line 3—3 of FIG. 2.
Figure 5:
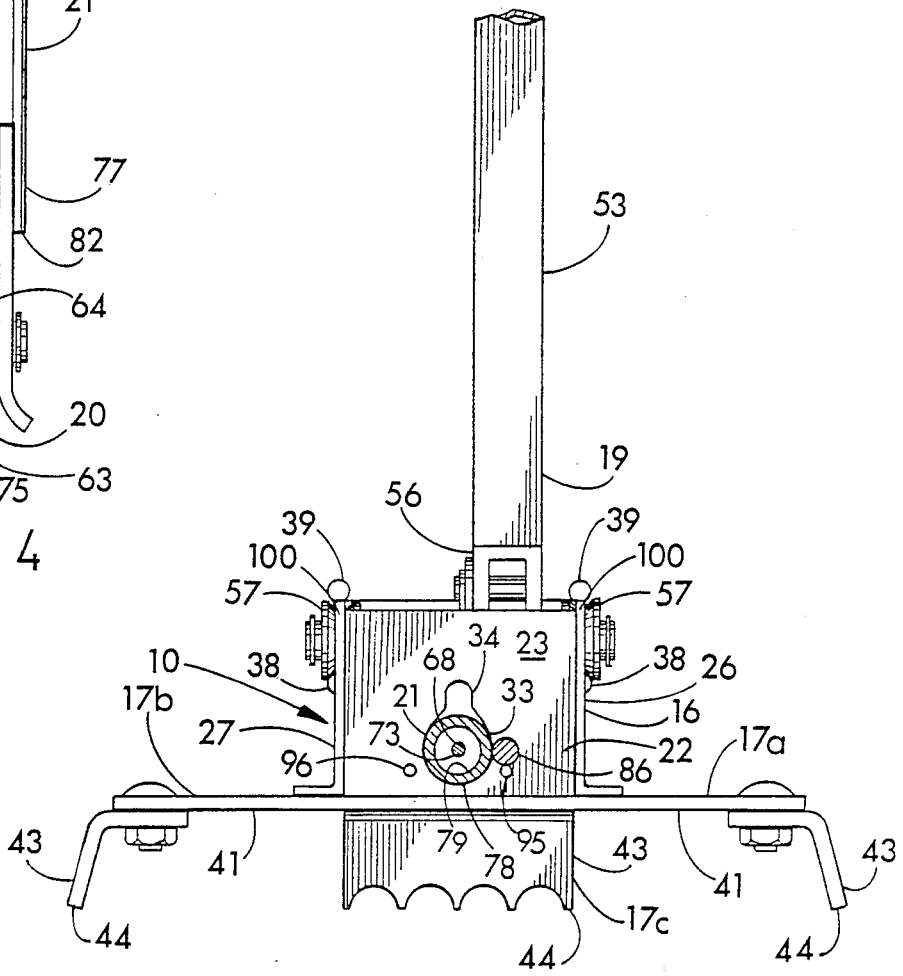
FIG. 5 is a section view taken along section line 5—5 of FIG. 2.

The frame 16 includes a front end 22 which is formed by a forward vertical wall 23, a rear end 25, a left side 26, a right side 27, and a channel portion 29 which extends between the two sides 26 and 27 of the frame 16. The channel portion 29 includes two intermediate vertical walls 31 and 32 which are best shown in FIG. 3. As shown in FIG. 5, the forward vertical wall 23 has a hole 33 and a keyway 34 above and adjoining the hole 33 which together receive and slidably and pivotably hold the extender 21. The intermediate vertical wall 32 also has a hole 36 which slidably and pivotably holds the extender 21. Another intermediate wall 31 has a large opening 35 which allows the extender 21 to pass through the wall 31, but which does not hold or position the extender 21 in any way. Each side 26 and 27 of the puller frame 16 furthermore includes a connected longitudinal guide rail 38 and a longitudinal guard rail 39 which is in a vertical spaced relation to the guide rail 38. Each guide rail 38 and its paired guard rail 39 together define a slot 40 in which a portion of the leveraged hand drive 19 slidably moves.

Fixed to or integrally connected to the frame 16 are three anchors, 17*a*, 17*b*, and 17*c*, each including an outwardly extending leg 41 which is connected to the frame 16, and a foot 43 which is connected to the leg 41. Each foot 43 includes serrated teeth 44 which grip the flat roof 11 and thereby maintain the puller frame 16 in the position that the operator places it. The anchor 17*c* which is connected to the rear end 25 of the frame 16 has an extending leg 41 which extends rearwardly from the frame 16 and which includes an upward surface 46 on which the foot of the operator may be placed to hold the puller frame 16 firmly in place on the roof 11. The outwardly extending legs 41 of anchors 17*a* and 17*b* are connected to the left and right sides 26 and 27 of the frame 16 near the front end 22 thereof. Each of these outwardly extending legs 41 extend sidewardly from its respective side 26 or 27 of the frame 16.

The locking gripper 12 is a tong-like apparatus having two flat jaws which grip the membrane sheet 13 when the tongs 48 are in their closed position. The jaws 47 may be opened by forcing apart the tongs 48.

The leveraged hand drive 19 includes a lever 50 which at its lower end 51 is pivotally connected to the frame 16 near the rear end 25 of the frame 16. At the upper end 52, the lever 50 is grasped by an operator's hand to move the lever 50 and apply a force to the lever 50 in a driving direction which is parallel to the longitudinal axis of the frame 16 in the direction of the front end 22 of the frame 16. The leveraged hand drive 19 furthermore includes a rod 53 with a pivotal end 55 which is pivotally mounted to the lever 50 a selected distance above the lower end 51 of the lever 50, and a slidable end 56 which is slidably mounted to the two sides 26 and 27 of the puller 10. The distance above the lower end 51 of the lever 50 which the rod 53 is connected to the lever 50 must be large enough so that the portion of the lever 50 below the rod 53 forms a lever arm which moves the rod 53 when the lever 50 is moved. Two wheels 57 are rotatably connected to the slidable end 56 of the rod 53, one wheel 57 resting within each slot 40 formed by a guiderail 38 and a guardrail 39. As the lever 50 is moved forwardly and rearwardly, the wheels 57 also move forwardly and rearwardly in their respective slots 40 and the rod 53 pivots at its pivotal end 55 with respect to the lever 50. Therefore, as the lever 50 is moved forwardly, the rod 53 also moves forwardly, and as the lever is pulled rearwardly, the rod 53 moves rearwardly. The preferred lever 50 is bent rearwardly at 59 so that the upper portion 60 of the lever can be more conveniently grasped by the operator. Rod 53 is pivotally connected to the lower portion 61 of the lever 50 in such a fashion that the rod 53 is roughly perpendicular to the lower portion 61 of the lever when the wheels 57 are in about the middle of their respective slots 40.

The pulley-cable system 20 transmits the pulling force from the leveraged hand drive 19 to the locking gripper 12 to pull the membrane 13 across the flat roof 11. The pulley-cable system 20 includes an exit pulley 63 which is in a connected relation to the front end 22 of the frame 16 by way of the extender 21. Specifically, the exit pulley 63 is connected to the extender 21 at the outward end 77 thereof. This exit pulley 63 has a groove 64 therearound, and has at least one position in which its turning axis is perpendicular to the roof 11 as shown in FIG. 1. In certain positions, the extender 21 is able to pivot so that the turning axis of the exit pulley 63 is changed with respect to the flat roof 11. The pulley-cable system 20 furthermore includes an intermediate pulley 65 which is rotatably mounted to the sides 26 and 27 of the frame 16 near the rear end 25 of the frame 16. This intermediate pulley 65 also has a groove 66 therearound. The pulley-cable system 20 furthermore includes a cable 68 with a first end 69 which is connected to the leveraged hand drive 19 near the slidable end 56 of the rod 53, and a second end 70 which is connected to the locking gripper 12. Preferably the cable 68 extends from the leveraged hand drive 19 in an initial direction which is generally opposite the driving direction of the lever 50 to define an initial portion 72 of the cable 68 which ends at the intermediate pulley 65. The cable 68 then passes around the groove 66 of the intermediate pulley 65 to extend in an intermediate direction to the exit pulley 63 to thereby define an intermediate portion 73 of the cable 68. The intermediate direction is generally parallel to the driving direction so that the operator may apply a pulling force to the cable 68 by moving the lever 50 in a direction generally toward the exit pulley 63. The cable 68 then passes through at least a portion 74 of the exit pulley groove 64 to extend in a final direction to the locking gripper 12 to thereby define a final portion 75 of the cable 68. The final direction is determined by the selected relative positions of the exit pulley 63 and the locking gripper 12. Since the first end 69 of the cable 68 is connected to the rod 53 near its slidable end 56, when the operator moves the lever 50 in the driving direction, the rod 53 pivotally slides in the driving direction thereby pulling the initial portion 72 of the cable 68 in the driving direction.

Figure 4:
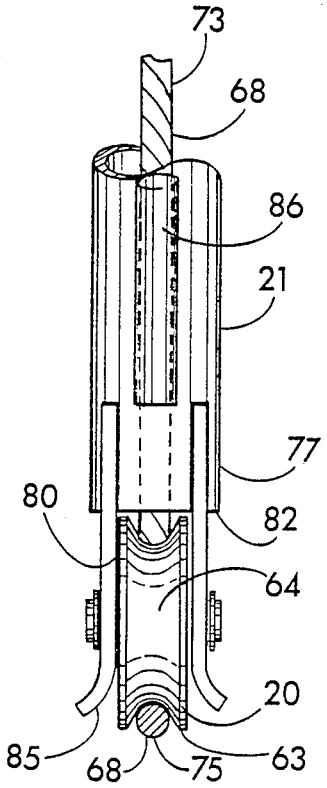
FIG. 4 is a section view taken along section line 4—4 of FIG. 2.

As shown in FIGS. 2 and 4–5, the extender 21 includes a shaft 78 having a bore 79 through which part of the intermediate portion 73 of the cable 68 passes from within the frame 16 to the exit pulley 63, and a pulley housing 81 which is connected to the far end 82 of the shaft 78 for housing the exit pulley 63. The pulley housing 81 has an open front 85 and an open side 80 as shown in FIG. 4. The exit pulley 63 is rotatably mounted within the pulley housing 81 in such a manner that a portion 74 of the exit pulley groove 64 is aligned with the bore 79 of the shaft 78. The hole 33 in the forward vertical wall 23 and the hole 36 in the intermediate wall 32 are adapted to receive and slidably and pivotally hold the shaft 78 so that the exit pulley 63 can be moved forwardly and reawardly and also so that the turning axis of the exit pulley can be pivoted. Located at the back end 83 of the shaft 78 is a stop 84 which prevents the back end 83 of the shaft 78 from moving forwardly of the intermediate vertical wall 32. The opening 35 in the intermediate wall 31 is so large that it allows the shaft 78 and stop 84 to pass forwardly therethrough to the other intermediate wall 32. The extender further includes a first key 86 which is connected to and extends longitudinally on the shaft 78 from the pulley housing 81 to a first keyless portion 87 of the shaft 78. The first key 86 includes a rearward face 88 and is cross-sectionally sized to be able to enter and slide through the keyway 34 located in the forward vertical wall 23 as the shaft 78 slides through the hole 33. Additionally, the extender 21 includes a second key 89 which is connected to the shaft 78 in axial alignment with the first key 86 and extends longitudinally from the first keyless portion 87 of the shaft 78 to the second keyless portion 91 of the shaft 78. The second key 89 includes a forward face 92 and a rearward face 93 and is cross-sectionally sized to enter the keyway 34 so that the shaft 78 can be slid between the keyless portions 87 and 91 of the shaft 78.

The roofing membrane puller 10 additionally includes two rests 95 and 96 which each extend forwardly from the forward vertical wall 23 at either lower side of the hole 33. Whenever a keyless portion 87 or 91 of the shaft 78 is located in the hole 33, the extender 21 may be pivoted so that the key 86 or 89 whose rearward face 88 or 93 is adjacent the forward vertical wall 23 can rest on either the left rest 95 or the right rest 96. FIGS. 2 and 5 show the extender 21 with the first keyless portion 87 of the shaft 78 located in the hole 33, and the extender 21 pivoted so that the first key 86 rests on the left rest 95. Since the first keyless portion 87 is located in the hole 33, the extender 21 may be pivoted so that the first key 86 would rest on the right rest 96, or so that the first key 86 would be aligned with the keyway 34 so that either the first or second key 86 or 89 could enter the keyway 84. When the first keyless portion 87 of the shaft 78 is located in the hole 33, the extender 21 is considered to be in its first extended position. If the extender 21 is pushed rearwardly, the first key 86 and shaft 78 can slide through the keyway 34 and hole 33 until the extender 21 has reached its retracted position where the pulley housing 81 abuts against the forward vertical wall 23 with the exit pulley 63 turning axis parallel to the roof 11. This retracted position is the normal position of the extender 21 when the puller is used with its front end 22 facing a membrane sheet 33. In this retracted position with the exit pulley housing open side 80 facing upwardly, the cable 68 generally passes only through the portion 74 of the exit pulley groove 64. The pulley housing 81 furthermore includes a pin 98 which helps to retain the cable 68 in the portion 74 of the exit pulley groove 64. With the extender 21 in its retracted position, the cable 68 normally exits the open front 85 of the pulley housing 81 in a direction which is generally close to being aligned with the shaft 78.

Of course, the extender 21 could have been moved forwardly so that the second key 89 instead entered the keyway 34 so that the second key 78 is pushed through the keyway 34 and hole 33 until the second keyless portion 91 of the shaft 78 is located in the hole 33. At this second extended position, the extender 21 again may be pivoted so that the second key 89 can rest either on the left or right rest 95 or 96 or be aligned with the keyway 34. When a key 86 or 89 rests on one of the rests 95 or 96, as shown in FIGS. 2 and 5 where the first key 86 rests on the left rest 95, the side 80 of the pulley housing 81 faces in a sideward direction and the turning axis of the exit pulley 63 is perpendicular to the roof 11. Therefore, the cable 68 can be directed in the sideward direction which the open side 80 of the pulley housing 81 faces. With the extender 21 so extended, and the turning axis of the exit pulley 63 perpendicular to the roof 11, the roofing membrane puller 10 can be placed near the edge 14 of the roof 11 with the front end 22 of the frame 16 directed obliquely toward the edge 14 of the roof 11 so that the extender 21 projects the exit pulley 63 outwardly nearly to the edge 14 of the roof 11 as shown in FIG. 1. In fact, it is even possible to extend the exit pulley 63 out over the edge 14 of the roof 11. In this position the exit pulley 63 can be used to help direct the membrane 13 which is being pulled to a location near the edge 14 of the roof 11 where the membrane 13 can be fastened to the roof 11. When the extender 21 is in its first extended position as shown in FIG. 2, the rearward face 88 of the first key 86 prevents rearward movement of the extender 21 and the forward face 92 of the second key 89 prevents forward movement of the extender 21, unless the keys 86 and 89 are aligned with the keyway 34. When the extender 71 is located in its second extended position, the rearward face 93 of the second key 89 prevents rearward movement of the extender 21 and the stop 84 prevents forward movement of the extender 21, unless the second key 89 is aligned with the keyway 34 so that the extender 21 may be moved rearwardly.

In its operation, the roofing membrane puller 10 of FIG. 1 is designed to be useful in pulling sheets of water-proof roofing membrane 13 over flat roofs, even to the edges 14 thereof. When pulling a waterproof membrane 13 over a flat roof 11, but not to the edge 14 thereof, the puller 10 may be positioned on the roof 11 so that its front 22 faces the membrane 13, and the extender 21 is in its retracted position with the side 80 of the pulley housing 81 facing upwardly. In this retracted position, the pulley housing 81 abuts against the forward vertical wall 23. The cable 68 comes out the open front 85 of the pulley housing 81, passing through only a portion 74 of the exit pulley groove 64 and resting on the pin 98. The puller 10 should be placed close enough to the membrane 13 so that when the lever 50 is in its rearward position, the cable 68 and locking gripper 12 can be pulled forwardly so that the jaws 47 of the locking gripper can be closed on the water-proof membrane 13. The operator can place his/her foot on the upward surface 46 of the rear anchor 17c to hold the puller 10 firmly in place. The operator may grab the lever 50 by its upper end 52 and push the lever 50 in a forward direction toward exit pulley 63. This forward movement of the lever 50 causes the rod 53 to draw the initial portion 72 of the cable in a forward direction, the intermediate portion 73 of the cable in a rearward direction, and the final portion 75 of the cable 68 and locking gripper 12 in a rearward direction along with the membrane 13. Pushing the lever 50 all the way to its forward position will cause the locking gripper 12 and the grasped membrane 13 to move rearwardly all the way to the pulley housing 81. The membrane 13 should be pulled tautly over the roof 11 so that the wrinkles are removed. When the membrane 13 has been pulled as far as it should be by the puller 10, the portion 99 of the membrane adjacent to the locking gripper 12 may be fastened to the roof 11. The locking gripper 12 may then be removed from the membrane 13, and the puller 10 moved so that another portion of the membrane 13 can be pulled.

When a portion of the membrane 13 is to be pulled nearly to the edge 14 of the flat roof 11, the puller 10 should be placed near the edge 14 of the roof 11 either so that its longitudinal axis is parallel to the edge 14 of the roof 11, or so that the forward vertical wall 23 is directed slightly toward the edge 14 of the roof 11. With the extender 21 in one of its extended positions, and the longitudinal axis of the puller 10 inclined slightly from being parallel to the edge 14 of the roof 11, the exit pulley 63 may be projected outwardly nearly to the edge 14 of the roof 11, and even over the edge 14 of the roof 11. When the puller 10 is placed with its right side 27 facing the edge 14 of the roof 11, the extender 21 should be pulled forwardly into one of its extended positions and pivoted so that the open side 80 of the pulley housing 81 faces leftwardly toward the membrane 13 as shown in FIG. 1. If the left side 26 of the puller 10 faces the edge 14 of the roof 11, the extender 21 should be pivoted so that the open side 80 of the pulley housing 81 faces in a rightward direction toward the membrane 13. In either case, the cable 68 can be pulled around the exit pulley groove 64 sidewardly so that the locking gripper jaws 47 can be locked to the membrane 13. Again, when the operator pushes the lever 50 forwardly, the membrane 13 and locking gripper 12 will be drawn by the cable 68 toward the pulley housing 81. When the membrane 13 is pulled as far as it should go, a portion 99 of the membrane 13 adjacent to the locking gripper 12 should be fastened to the roof 11.

Although the preferred embodiment of the puller 10 shown has an intermediate pulley 65 so that the puller is operated by pushing the lever 50 in a forward direction, alternatively the puller 10 could be made without the intermediate pulley 65 so that the puller 10 would be operated by pushing the lever 50 in a rearward direction. In such a case, it might be desirable to pivotally connect the lower end 51 of the lever 50 near the front end 22 of the frame 16, with the rod 53 and slots 40 located to the rear of the lever 50. Alternatively, the leveraged hand drive 19 could be constructed so that the first end 69 of the cable 68 would be connected directly to the lever 50. Such an embodiment might require an additional pulley which would direct the cable 68 from its longitudinal path up toward the middle portions of lever 50. In such an embodiment, the longitudinal guiderails 38 and longitudinal guardrails 39 which form the slots 40 would be unnecessary. In another alternative embodiment, each guiderail 38 could be formed by an upper edge 100 of either side 26 or 27 of the frame 16. Each longitudinal guardrail 39 then could be formed by a rod having its ends bent downwardly with these ends welded to the upper edge 100 of a side 26 or 27 and with the long horizontal portion of the rod thereby forming the guardrail. In still another alternative, the slots 40 could be formed simply by cutting longitudinal slots into the sides 26 and 27 of the frame 16. In the preferred embodiment shown in FIGS. 1–3 and 5, the extender 21 includes two keys 86 and 89 and two keyless portions 87 and 91 of the shaft 78. Alternatively, the extender 21 could include a greater number of shorter keys, and accordingly a greater number of keyless portions on the shaft 78, so that the extender 21 could be adjusted into a greater number of extended positions. Although the preferred embodiment of the puller 10 includes the extender 21, the exit pulley 63 could be directly connected to the forward vertical wall 23 in such a fashion that the turning axis of the pulley 63 would be perpendicular to the roof. In such an embodiment, the cable 68 could come around either side of the pulley 63 to extend either in a forward direction, or to pass around the pulley groove 64 in a sideward direction.

The present invention is particularly useful because it can be used to tautly pull water-proof membranes over flat roofs 11, even to the edges thereof. In pulling the membrane, the roofing membrane puller reduces the wrinkling of the membrane and thereby greatly increases the aesthetic appearance of the roof. The upward surface 46 on the rear anchor 17c allows an operator to place his/her foot on the anchor to hold the puller frame firmly in place on the roof. The use of pulleys in the puller 10 allows the pulling force to change directions so that the puller can be operated by moving the lever 50 in a forward direction, and the puller 10 can be operated even when its front end 22 is not facing the membrane 13.

It is to be understood that the present invention is not limited to the particular arrangement and embodiments of parts disclosed and illustrated herein, nor to the materials specified, but embraces all such modified forms thereof as come within the scope of the following claims.

What is claimed is:

1. A roofing membrane puller for tautly pulling a water-proof membrane over a flat roof, which comprises:

(a) a frame including a front end, a rear end, and two sides;

(b) at least one anchor which maintains the frame in a selected position on the flat roof;

(c) a sheet gripper for gripping the membrane;

(d) a leveraged hand drive which is mounted to the frame and includes a lever which at a lower end is pivotably mounted to the frame and at another end is grasped by an operator's hand to move the lever and apply a force to the lever in a driving direction which is parallel to the longitudinal axis of the frame;

(e) a pulley-cable system for transmitting a pulling force from the leveraged hand drive to the locking gripper to pull the membrane, the system including:

(i) an exit pulley which is in a connected relation to the frame near the front end thereof, the exit pulley defining a groove therearound and connected to be positionable so as to have at least one position in which a turning axis of the exit pulley is perpendicular to the roof;

(ii) a cable including a first end which is connected to the leveraged hand drive and a second end which is connected to the locking gripper, the cable extending from the leveraged hand drive in an initial direction which is generally opposite the driving direction of the lever to define an initial portion of the cable, the cable passing through at least a portion of the exit pulley groove to extend in a final direction to the locking gripper to define a final portion of the cable, the final direction being determined by selected relative positions of the exit pulley and the locking gripper; and (f) an extender comprising a shaft connecting the exit pulley to the frame, at least a portion of the shaft extenable outwardly from the front end of the frame, the exit pulley being connected to the shaft at an outward end thereof, wherein the frame includes a forward vertical wall and an intermediate vertical wall, each being connected to the sides of the frame and having a hole therein for slidably and pivotably holding the shaft so that the exit pulley can be moved forwardly and rearwardly, and its turning axis pivoted, wherein the roofing membrane puller can be placed near the edge of the roof with the front end thereof directed obliquely toward the edge of the roof so that the extender projects the exit pulley nearly to the roof edge.

2. The roofing membrane puller of claim 1 wherein the forward vertical wall has a keyway above and adjoining the hole within the wall; wherein the extender further includes a first key which is connected to and extends longitudinally on the shaft from the pulley housing to a first keyless portion of the shaft, the first key including a rearward face and being cross-sectionally sized to enter and slide through the keyway as the shaft slides through the hole; wherein when the keyway has received the first key, the extender can slide between a retracted position where the pulley housing abuts against the forward wall with the exit pulley turning axis parallel to the roof, and a first extended position where the first key exits forward of the keyway and the hole receives the first keyless portion of the shaft; and wherein when the hole receives the first keyless portion of the shaft, the extender can pivot with the first key moving to either side of the hole and keyway so that rearward movement of the extender is prevented by the rearward face of the first key abutting against the forward vertical wall.

3. The roofing membrane puller of claim 2 further including two rests which each extend forwardly from the forward vertical wall at either lower side of the hole so that when the shaft is pivoted with a key moving to either side of the hole and when the key abuts against one of the rests, and the exit pulley turning axis is perpendicular to the flat roof so that the cable can exit from the pulley housing in a sideward direction.

4. The roofing membrane puller of claim 3 wherein the extender further includes at least one key which is connected to the shaft and extends longitudinally from one keyless portion of the shaft to another keyless portion of the shaft in axial alignment with the first key, the key including a forward face and a rearward face and being cross-sectionally sized to enter the keyway so that the shaft can be slid between the keyless portions of the shaft; wherein when the hole receives the keyless portion of the shaft adjacent to the forward face of the key, the extender can pivot sidewardly so that forward movement of the extender is prevented by the forward face of the key abutting against the forward vertical wall; and wherein when the hole receives the keyless portion of the shaft adjacent to the rearward face of the key, the extender can pivot sidewardly so that rearward movement of the extender is prevented by the rearward face of the key abutting against the forward vertical wall, and the key can abut against either rest.

5. The roofing membrane puller of claim 1 wherein the pulley cable system further includes an intermediate pulley to which the initial portion of the cable extends, the intermediate pulley being rotatably mounted to the frame and defining a groove around the pulley through which the cable passes to extend in an intermediate direction to the exit pulley to define an intermediate portion of the cable, the intermediate direction being generally parallel to the driving direction so that an operator can apply a pulling force to the cable by moving the lever in a direction generally toward the exit pulley.

6. The roofing membrane puller of claim 1 wherein the leveraged hand drive further includes a rod with a pivotal end which is pivotally mounted to the lever a selected distance above the lower end of the lever, and a slidable end which is slidably mounted to at least one side of the puller frame, the first end of the cable being connected to the rod near the slidable end thereof so that when the operator moves the lever in the driving direction, the rod pivotally slides in the driving direction, pulling the initial portion of the cable in the driving direction.

7. The roofing membrane puller of claim 6 wherein the leveraged drive mechanism further includes at least one wheel which is rotatably connected to the slidable end of the rod, and at least one side of the frame further includes a longitudinal guiderail on which the wheel rests and can roll to allow the slidable end of the rod to slide forwardly and rearwardly.

8. The roofing membrane puller of claim 7 wherein the sides of the frame which include a longitudinal guiderail each furthermore include a longitudinal guardrail in a vertical spaced relation to the guiderail and overlying the wheel in close proximity thereto to maintain the wheel on the guiderail, each guiderail and its paired guardrail together defining a slot in which the wheel rotatably moves forwardly and rearwardly.

9. The roofing membrane puller of claim 1 wherein at least one anchor comprises an outwardly extending leg which is connected in supportive relation to the frame, and a foot which is fixedly connected to the leg and includes serrated teeth for gripping the flat roof to thereby maintain the position of the puller frame.

10. The roofing membrane puller of claim 9 wherein the extending leg is connected to the rear end of the frame extending rearwardly therefrom and includes an upward surface on which a foot of the operator may be placed to hold the puller frame firmly in place on the roof.

11. The roofing membrane puller of claim 9 wherein the outwardly extending leg of at least one anchor is connected to a side of the frame near the front end thereof and extends sidewardly from the side of the frame.

* * * * *